US005678128A

United States Patent [19]

Ikeda et al.

[11] Patent Number: 5,678,128

[45] Date of Patent: Oct. 14, 1997

[54] IMAGE FORMING APPARATUS HAVING A PLURALITY OF IMAGE FORMING STATIONS

[75] Inventors: Yoshinori Ikeda; Motoaki Tahara; Michio Kawase, all of Kawasaki, Japan

[73] Assignee: Canon Kabushiki Kaisha, Tokyo, Japan

[21] Appl. No.: 362,988

[22] Filed: Dec. 23, 1994

[30] Foreign Application Priority Data

Dec. 29, 1993 [JP] Japan ..... 5-354346

[51] Int. Cl.[6] ..... G03G 15/00

[52] U.S. Cl. ..... 399/49; 399/72

[58] Field of Search ..... 355/309, 313, 355/326 R, 327, 203, 202, 210; 399/49, 72

[56] References Cited

U.S. PATENT DOCUMENTS

| | | | |
|---|---|---|---|
| 4,796,050 | 1/1989 | Furuta et al. | 355/326 R |
| 5,041,877 | 8/1991 | Matsumoto | 355/271 |
| 5,191,361 | 3/1993 | Abe | 355/326 X |
| 5,198,858 | 3/1993 | Sugawa et al. | 355/202 |
| 5,204,725 | 4/1993 | Ariyama et al. | 355/313 |
| 5,296,897 | 3/1994 | Amemiya et al. | 355/208 |
| 5,303,006 | 4/1994 | Mizude | 355/208 |
| 5,305,059 | 4/1994 | Kurosawa | 355/208 |
| 5,434,649 | 7/1995 | Hasuo et al. | 355/201 |

*Primary Examiner*—William J. Royer

*Attorney, Agent, or Firm*—Fitzpatrick, Cella, Harper & Scinto

[57] ABSTRACT

An image forming apparatus includes a transporter for transporting a transfer medium to a plurality of image forming stations for transferring images in sequence onto the transfer medium. Each of the plurality of image forming stations has a recording medium onto which a transferred image is formed, an image forming device for forming the image on the recording medium, and a detector for detecting a state of the image formed on the recording medium. A controller operates in first and second modes, wherein the first mode operating conditions of the image forming device are determined based on a detected state of the image formed on the recording medium, and wherein in the second mode, the image forming device is controlled based on the operating conditions determined in the first mode. The controller operates each image forming device in the plurality of image forming stations simultaneously during first mode, and operates the image forming devices in sequence, at predetermined time intervals, during the second mode.

9 Claims, 14 Drawing Sheets

IMAGE FORMING APPARATUS HAVING A PLURALITY OF IMAGE FORMING STATIONS

BACKGROUND OF THE INVENTION

1. Field of the Invention

The present invention relates to an image forming apparatus having a plurality of image forming stations.

2. Description of the Related Art

FIG. 15 is a schematic view illustrating the construction of a color image forming apparatus.

As shown in the figure, in the color image forming apparatus, paper leaf member P is wound around drum 1 called a transfer drum, color toner images formed for each color are superimposed on each other and transferred in sequence onto photosensitive drum 2, and thus a full color image print is obtained. Reference numeral 7 denotes a charging unit for uniformly charging the surface of the photosensitive drum 2. The optical system comprises a semiconductor laser 5, polygon mirror 4, and reflecting mirror 6. Laser light which is modulated in accordance with input image data is projected onto photosensitive drum 2, thus forming a latent image corresponding to the image data. Reference numerals 3-1, 3-2, 3-3 and 3-4 denote each development section of each color which sequentially develop and transfer latent images formed by the above process in the order of magenta, cyan, yellow, and black.

In this type of image forming apparatus, it is important that surface potential before exposure or after exposure be uniformly controlled because density and quality of the image is determined by the surface potential. For this reason, prior to formation of the image, surface potential is controlled. The surface potential of photosensitive drum 2 is measured by sensor 10, the output value of charging unit 7 is calculated by processing circuit 8 on the basis of the measured value, and charging unit 7 is controlled by drive circuit 9, in order to bring the surface potential of photosensitive drum 2 to a predetermined value.

FIG. 16 is a timing diagram illustrating an example of an image forming sequence of the color image forming apparatus shown in FIG. 15.

As shown in FIG. 16, after printing starts, surface potential control S is performed before paper feed F, after which image forming operations M, C, Y and K for forming images of each color, are performed, and paper containing the complete image is ejected at Q.

FIG. 17 is a schematic sectional view illustrating another example of a color image forming apparatus.

The color image forming apparatus shown in FIG. 17 has a photosensitive drum, a charging unit, an exposure section, and a transfer section arranged in parallel in order to obtain a still higher print output. These sections are driven in sequence, and toner images formed on each photosensitive drum are sequentially transferred to transfer paper, and thus a color image is obtained.

Referring to FIG. 17, image formation in the first station for magenta will be explained. Light emitted from semiconductor laser 16, after the image is modulated, is raster scanned by polygon mirror 15, reflected by mirrors 17, 18 and 19, and projected onto photosensitive drum 21. Reference numeral 20 denotes a charging unit for uniformly charging photosensitive drum 21, and for removing the charge on the surface of the drum according to the projected light, thereby forming a latent image. Reference numeral 22 denotes a developing apparatus for developing the latent image. The developed image is transferred to a paper leaf member P by transfer charging unit 23. Similarly, image formation in the stations for cyan, yellow and black are performed in sequence, partly in parallel, as shown in FIG. 18. When image formation in the final black station is complete, the superposition of toner images of the four colors terminates, and a full-color print is obtained. Reference numeral 49 denotes a sensor for detecting when paper is entering the apparatus and outputs a paper start signal PS indicating that paper is being passed beneath it, as shown in FIG. 18.

FIG. 19 is a block diagram illustrating an example of a circuit for generating the timing signals shown in FIG. 18.

As shown in FIG. 19, image formation timing signals for each color, MIMG (magenta) 101, CIMG (cyan) 102, YIMG (yellow) 103, and KIMG (black) 104, are generated on the basis of outputs from four counter circuits 52 to 55 with the signal PS, generated at the time when paper is inserted, being used as a reference.

SET1 (56) to SET4 (59) are values which are set in accordance with a distance L between the stations. Counter circuits 52 to 55 output a timing signal upon terminating counting the set value after the signal is input. Image formation is performed as shown in FIG. 20 on the basis of each timing signal generated by counter circuits 52 to 55. For example, magenta, image data VIDEODATA (1) and (2) are generated at timing MIMG shown in the timing diagram of FIG. 20, thus forming the image shown in FIG. 21(*a*), or forming the grayscale pattern shown in FIG. 21(*b*).

In such a color image forming apparatus having a plurality of drums, uniform gradation and color balance must be maintained for each color in order to maintain high image quality. For this reason, the above-described surface potential control is important. The surface potential must be controlled prior to image formation as is done in the prior art.

FIG. 22 is a timing diagram illustrating the image formation sequence of the four drum color image forming apparatus shown in FIG. 17. FIG. 22 shows a case in which a conventional sequence, which has hitherto been applied to one photosensitive drum, is applied to four photosensitive drums. The figure shows an example in which after a potential control sequence (EPC) is performed for each color, an image formation sequence (IMG) is performed.

For the above-described example, even for one print time, a time for about two prints is required to perform potential control. This is because the same sequence is used as the image formation timing for each color when an ordinary image formation operation for each color is performed. Thus, printing throughput is decreased, and, in particular, it takes a long time for a first copy to print.

SUMMARY OF THE INVENTION

It is an object of the present invention to provide an image forming apparatus in which the above-described problem is eliminated.

It is another object of the present invention to provide an image forming apparatus which is capable of shortening the time required for forming an image onto a recording medium by shortening the image control processing time necessary for each image forming section. The image control processing time is shortened by switching between a first mode, in which each image forming section is sequentially driven in synchronization with the transport of a recording medium, and a second mode, in which the image forming sections are simultaneously driven regardless of the transport of the recording medium.

According to one aspect, the present invention is an image forming apparatus which includes transport means for transporting a transfer medium and a plurality of image forming stations for transferring images in sequence onto the transfer medium. Each of the plurality of image forming stations has a recording medium onto which a transferred image is formed, image forming means for forming the image on the recording medium, and detecting means for detecting a state of the image formed on the recording medium. Control means operates in first and second modes, the first mode in which operating conditions of the image forming means are determined based on a detected state of the image formed on the recording medium, and the second mode in which the image forming means is controlled based on conditions determined in the first mode. The control means operates each image forming means in the plurality of image forming stations simultaneously during the first mode, and operates the image forming means in sequence, at predetermined time intervals, during the second mode.

According to another aspect, the present invention is an image forming apparatus which includes transport means for transporting a transfer medium, a plurality of image forming stations each having a recording medium, image forming means for forming an image on the recording medium, and transfer means for transferring the image formed on the recording medium to the transfer medium. Control means controls a time at which operation of the plurality of image forming stations starts. The control means operates each image forming means in the plurality of image forming stations simultaneously when the transport means does not transport a transfer medium, and operates each image forming means in the plurality of image forming stations in sequence when the transport means transports a transfer medium.

According to still another aspect, the present invention is an image forming apparatus, comprising transport means for transporting a transfer medium, a plurality of image forming stations each having a recording medium, image forming means for forming an image on the recording medium, and transfer means for transferring the image formed on the recording medium to the transfer medium. First control means controls a time at which operation of the plurality of image forming stations starts. The first control means operates each image forming means in the plurality of image forming stations simultaneously when the transport means does not transport a transfer medium, and operates each image forming means in the plurality of image forming stations in sequence when the transport means transports a transfer medium. Second control means detects an image quality state of the image formed on said recording medium, and performs an image control operation for detecting operating conditions of the image forming means based on the detected image quality state. The second control means operates each image forming means in the plurality of image forming stations simultaneously when the image control operation is performed.

According to still another aspect, the present invention is an image forming method for transferring, in sequence, images formed on each of a plurality of image forming stations to a transfer medium. The present invention includes operating each of a plurality of image forming stations simultaneously so that an image is formed on each image forming station, measuring an image quality state of the image formed on each of the image forming stations, and determining image forming conditions for each of the image forming stations based on the image quality state. Each of the image forming stations is operated in sequence in synchronization with a transport of a transfer medium according to the determined image forming conditions.

The above, aspects and novel features of the invention will more fully appear from the following detailed description when read in connection with the accompanying drawings.

DETAILED DESCRIPTION OF THE PREFERRED EMBODIMENTS

[First Embodiment]

Figure 17:
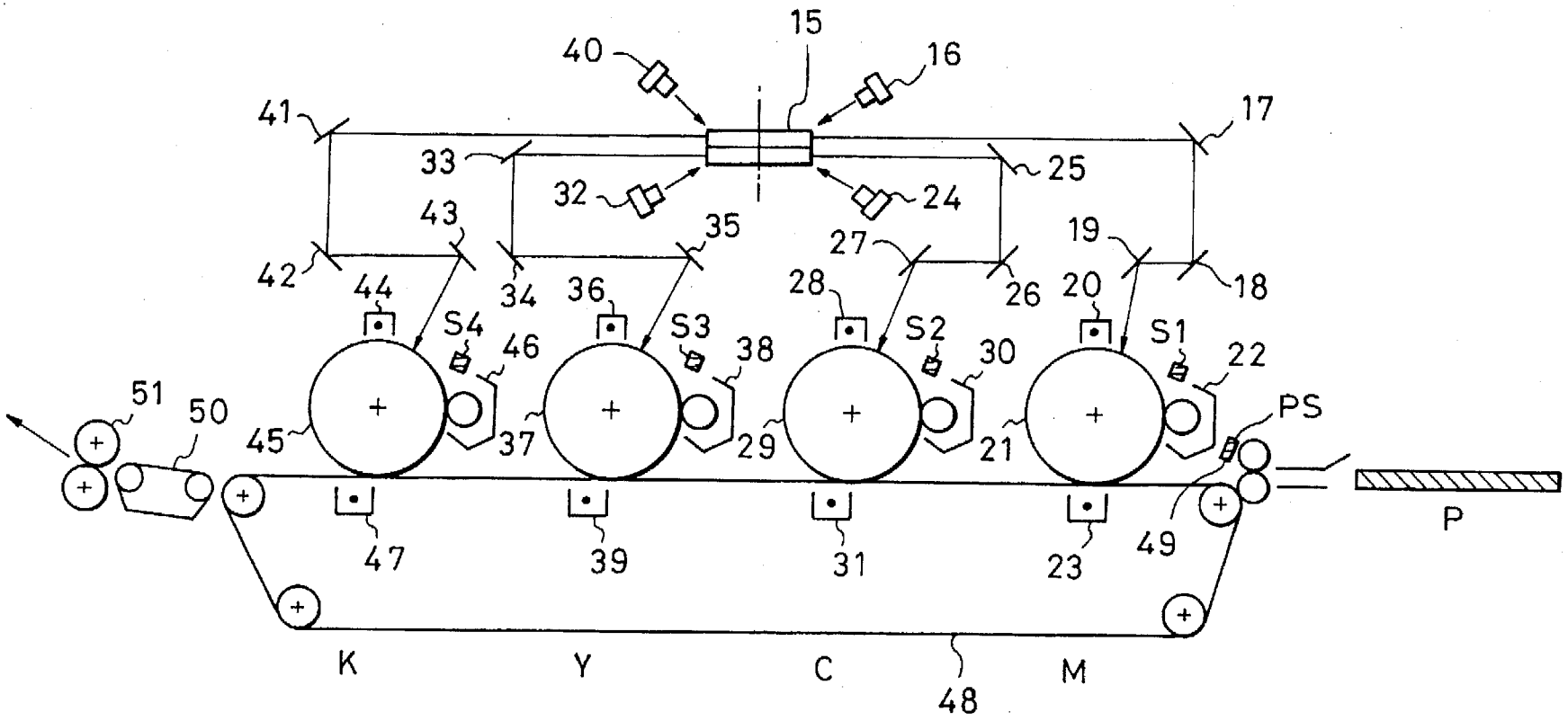
FIG. 17 is a schematic sectional view of another example of the color image forming apparatus of the present invention.
Figure 18:
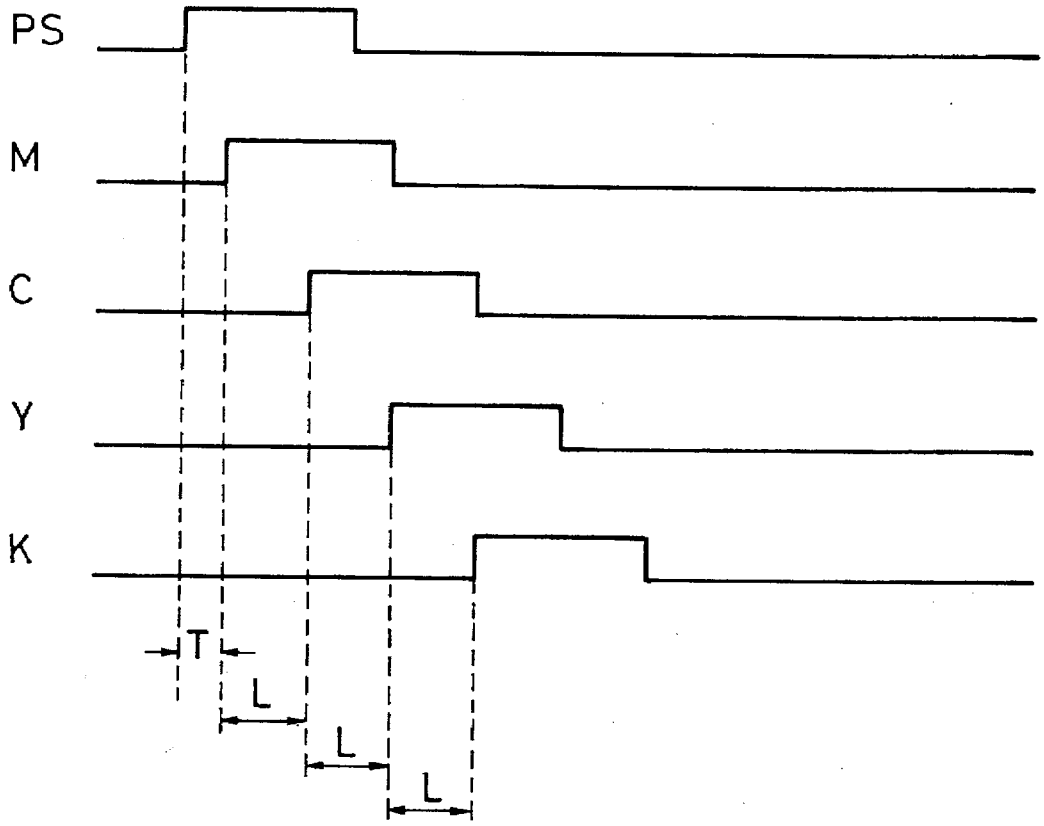
FIG. 18 is a timing diagram illustrating the image forming timing of each image forming section in the color image forming apparatus shown in FIG. 17.

The color image forming apparatus of this embodiment has four drums disposed side-by-side as shown in FIG. 17. A detailed explanation of each section is omitted.

Figure 1:
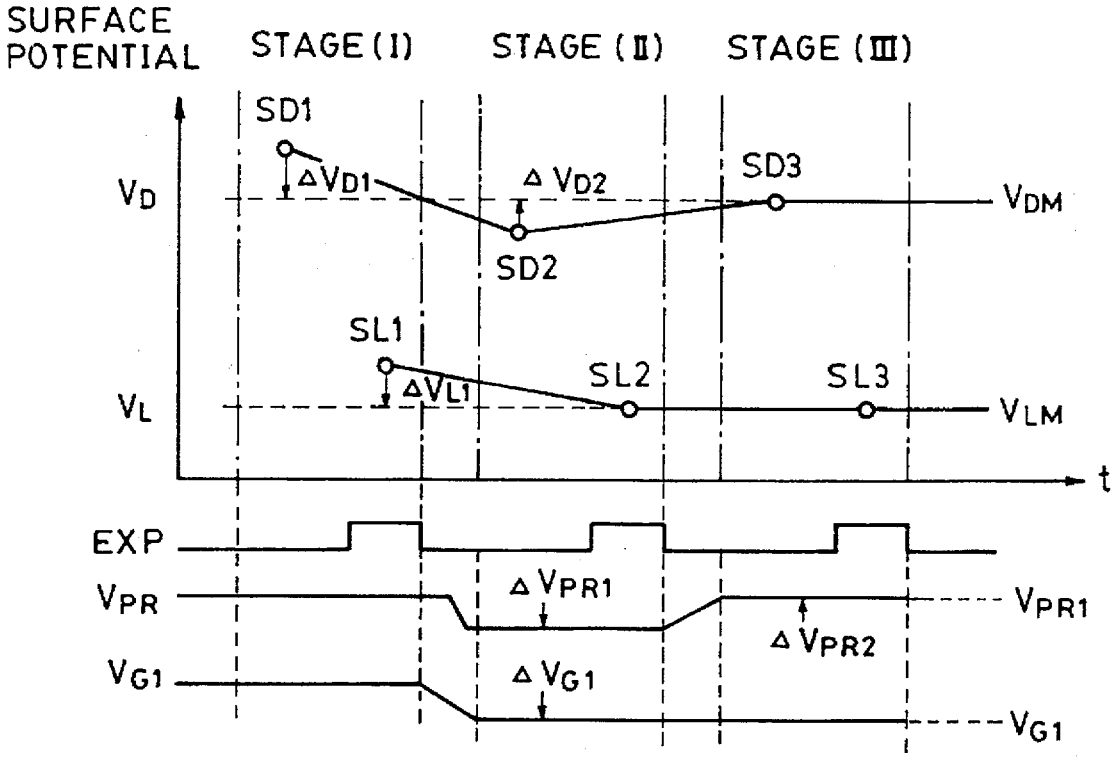
FIG. 1 shows surface potential control of a color image forming apparatus according to a first embodiment of the present invention.

FIG. 1 shows the concept of surface potential control of a color image forming apparatus according to the present invention. The horizontal axis indicates the sequence progress time, and the vertical axis indicates surface potential $V_L$ of an exposed portion of a photosensitive drum, surface potential $V_D$ of an unexposed portion, output value $V_{PR}$ of the primary charging unit, and output value $V_G$ of the primary grid charging unit.

The surface potential control of this embodiment lies in determining $V_{PR1}$ and $V_{G1}$, output values of the primary charging unit and the primary grid apparatus respectively, for setting the respective surface potentials $V_L$ and $V_D$ at respective target values $V_{LM}$ and $V_{DM}$, in order to secure an electrostatic latent image of a uniform potential on each photosensitive drum during image formation. In stage (1), $V_{PR}$ and $V_G$ are output as initial values, a laser beam is projected in response to a timing signal EXP in order to form an unexposed portion and an exposed portion of the drum, and surface potentials $V_D$ and $V_L$ are measured by the above-described surface potential sensors (sensors S1 to S4 shown in FIG. 17) at timings SD1 and SD2. In stage (2), if, for example, surface potentials $V_D$ and $V_L$ are higher than target values $V_{DM}$ and $V_{LM}$ by $\Delta V_{D1}$ and $\Delta V_{L1}$, respectively, $V_{PR}$ and $V_G$ are lowered by $\Delta V_{PR1}$ and $\Delta V_{G1}$, respectively. Then, a laser beam is projected again so that an unexposed portion and an exposed portion are formed. In this way, the same control is performed. By repeating the above-described surface potential control, for example, three times, $V_{PR1}$ and $V_{G1}$, for obtaining the target surface potentials $V_{DM}$ and $V_{LM}$, can be obtained.

Figure 2A:
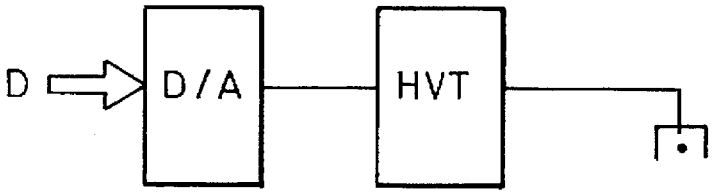
FIGS. 2(*a*) and 2(*b*) show the construction of a high-voltage transformer for controlling an output value of a primary charging unit in the color image forming apparatus of the present invention.
Figure 2B:
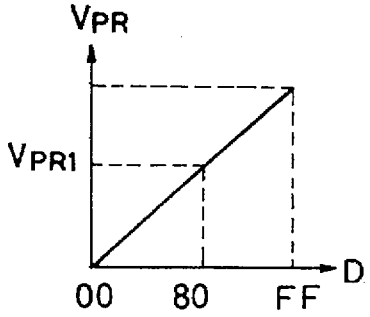

FIGS. 2(*a*) and 2(*b*) show the construction of a high-voltage transformer for controlling output value $V_{PR}$ (or $V_G$) of the primary charging unit in the color image forming apparatus of the present invention. FIG. 2(*a*) shows the circuitry thereof, and FIG. 2(*b*) shows the output level characteristic of a D/A converter shown in FIG. 2(*a*). For the output value $V_{PR}$ (or $V_G$) of the primary charging unit, a high voltage output is determined on the basis of the output level of the D/A converter, as shown in FIG. 2(*b*).

Figure 3A:
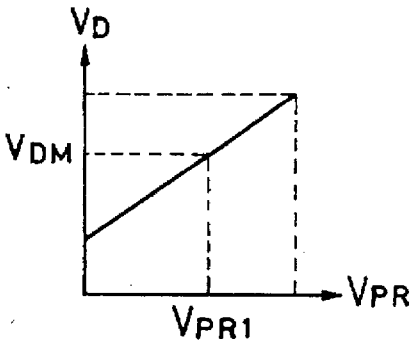
FIGS. 3(*a*) and 3(*b*) show the relationship between output from the primary charging unit and surface potential of an unexposed portion, and the relationship between output of the primary grid and surface potential of an exposed portion, in the color image forming apparatus of the present invention.
Figure 3B:
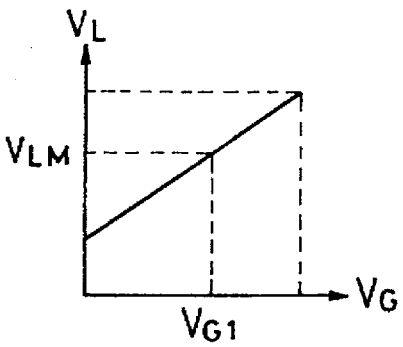

FIGS. 3(*a*) and 3(*b*) show the relationship between the output $V_{PR}$ from the primary charging unit and the surface potential $V_D$ of the unexposed portion, and the relationship between the output $V_G$ of the primary grid and the surface potential $V_L$ of the exposed portion.

Figure 4A:
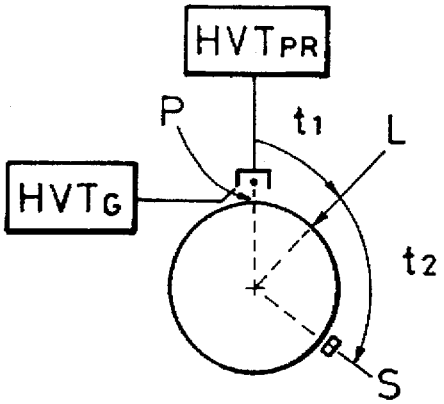
FIGS. 4(*a*) and 4(*b*) show the charging position, the exposure position, the sensor sampling position, and the time relationship among them in the color image forming apparatus of the present invention.
Figure 4B:
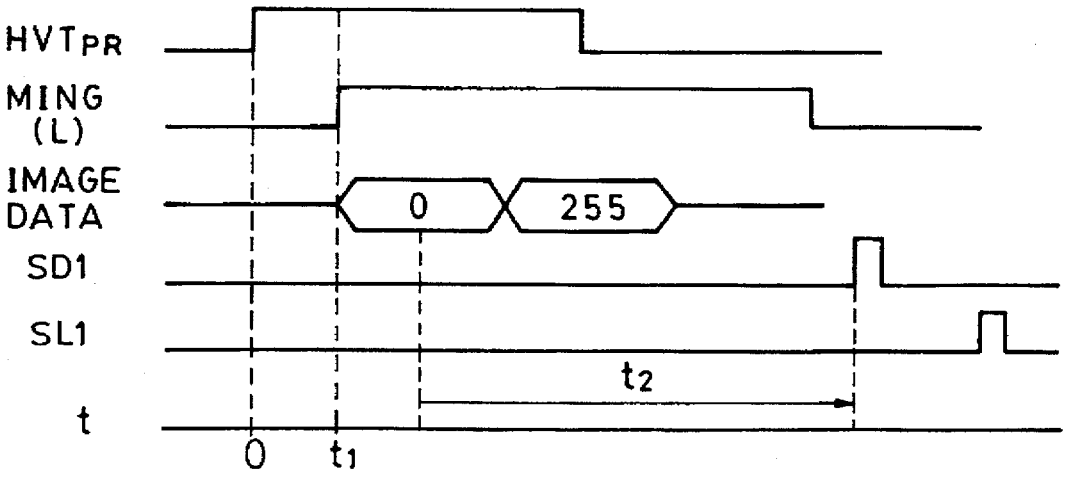

FIG. 4(*a*) shows charging position P, exposure position L, and sensor sampling position S in the color image forming apparatus, and FIG. 4(*b*) shows the timing relationship among them.

As shown in the FIG. 4(*a*), it takes time t1 for the photosensitive drum to move from the charging position P at primary charging unit $HVT_{PR}$ and primary charging unit $HVT_G$ to exposure position L. The unexposed portion and the exposed portion are formed by exposure to image data of density levels "00" and "255", respectively. Also, the surface potential is sampled in a central portion of the sample area.

Figure 5:
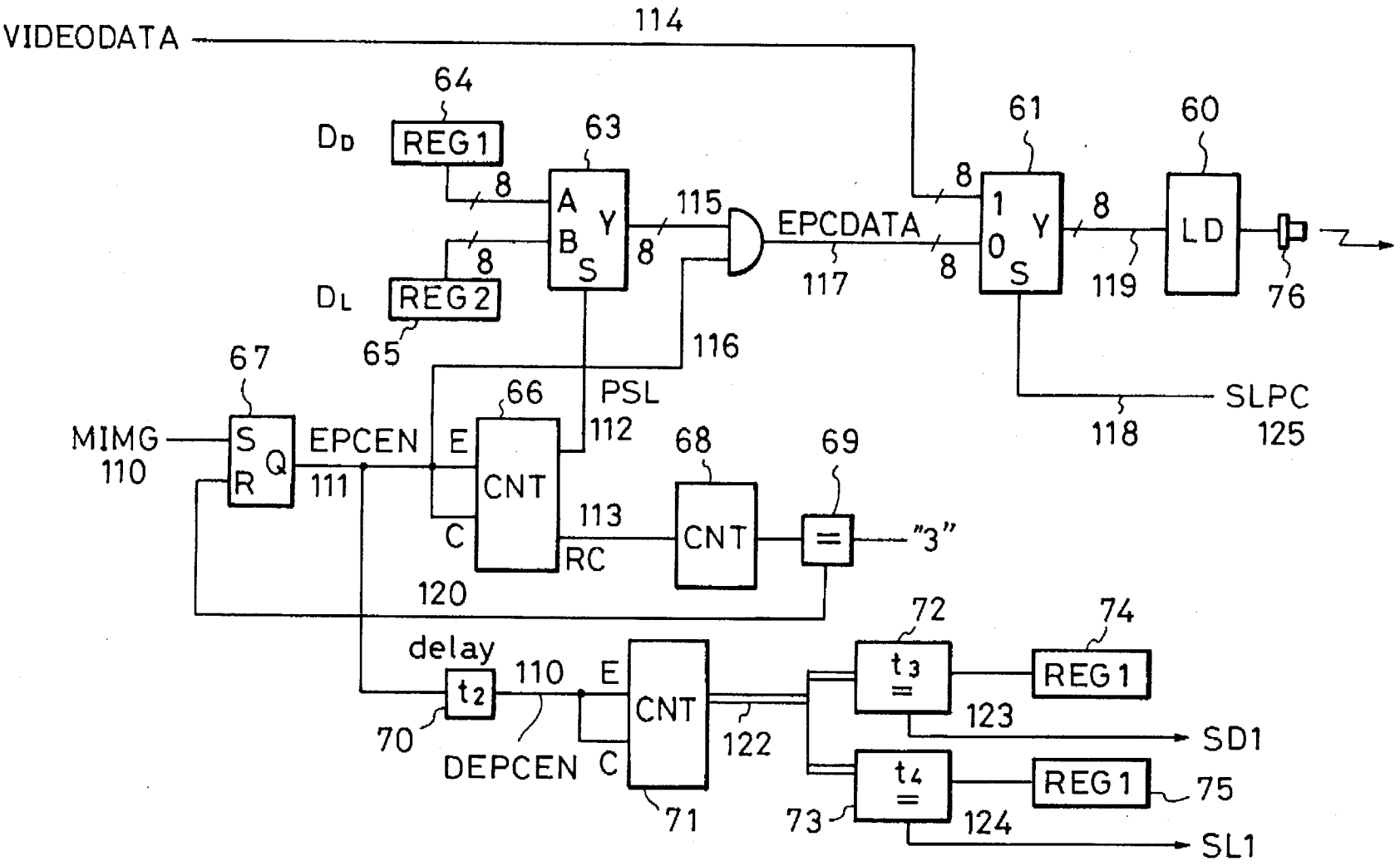
FIG. 5 shows a block diagram of a timing signal generating circuit in the color image forming apparatus of the present invention.
Figure 6:
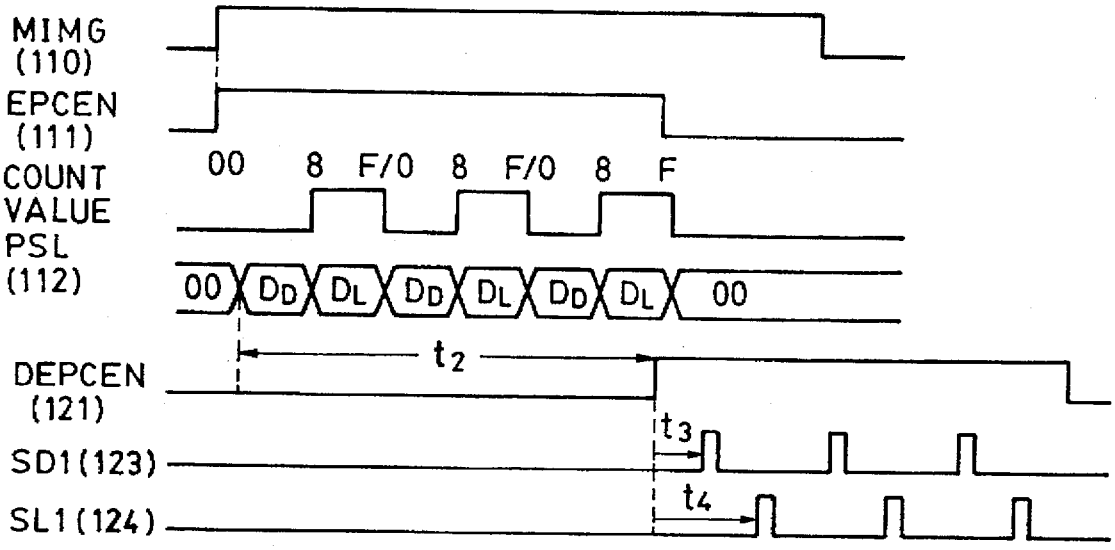
FIG. 6 is a timing diagram showing the operation of the timing signal generating circuit of FIG. 5.

FIG. 5 shows a timing signal generating circuit in the color image forming apparatus of the present invention. FIG. 6 is a timing diagram illustrating the operation of the timing signal generating circuit shown in FIG. 5.

Reference numeral 60 is drive circuit for driving semiconductor laser 76. Light emission power is determined in response to a value of digital signal 119. Reference numeral 114 denotes ordinary image data (VIDEODATA) for forming an image; and reference numeral 117 denotes exposure data (EPCDATA) for forming an unexposed portion and an exposed portion during surface potential control. The two data signals are switched by selector 61 in response to signal SLPC 125.

Register 64 (REG1) and register 65 (REG2) are set at exposure data "0" and "255", respectively, and are gated with signal EPCEN 111 indicating that surface potential control is in operation and input to the "0" input terminal of selector 61. Signal EPCEN 111 is output from S/R flip-flop 67 which is set by signal MIMG 110 indicating that the sequence starts, and reset when unexposure/exposure is repeated three times as shown in FIG. 6.

Counter 66 is a counter for generating a timing signal PSL which is used to determine when unexposure/exposure has occurred three times. The full count value is set so as to correspond to a time of one unexposure/exposure. Therefore, the MSB (Most Significant Bit) of counter 66 is made to correspond to signal PSL 112.

On the other hand, as explained with reference to FIG. 4, it takes time $t_2$ for the area on the photosensitive drum exposed by exposure section L to reach sensor section S. Therefore, pulse signals SD1 and SL1 are generated at timings $t_3$ and $t_4$ (shown in FIG. 6) by counter 71 according to signal DEPCEN 121 such that signal EPCEN 111 is delayed by time $t_2$ by delay circuit 70 (shown in FIG. 5).

In FIG. 6, signal MIMG 110 is a control start signal which is generated during surface potential control and ordinary image formation, as described below. Signal EPCEN 111 is a signal for controlling exposure. Data signals "$D_D$" and "$D_L$", for projecting a laser in response to signal PSL during interval "HI", are output to a laser drive circuit (e.g., a laser driver 60 shown in FIG. 5). Signals SD1 and SL1 are sampling pulses for sampling surface potential of the unexposed portion of the drum and the exposed portion of the drum, which are generated and delayed by time $t_2$ from the start of exposure, as explained with reference to FIG. 4.

Figure 7:
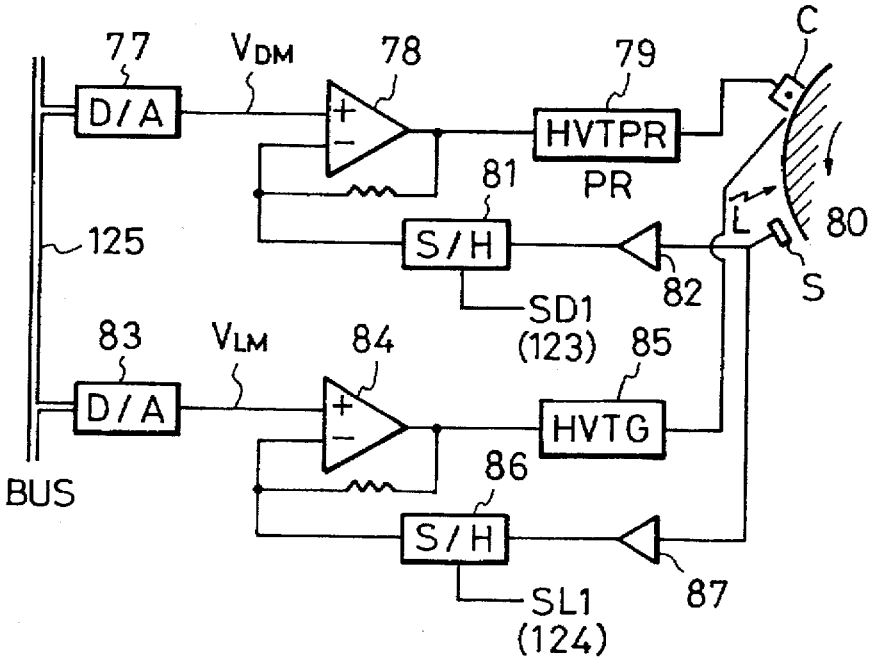
FIG. 7 shows a block diagram of an example of a surface potential measuring circuit.

FIG. 7 shows an example of a surface potential measuring circuit in the color image forming apparatus of the present invention.

In FIG. 7, reference numeral 80 is a photosensitive drum; reference character C is a primary charging unit; reference character S is a potential sensor; and reference character L is a laser beam. The surface of photosensitive drum 80 is uniformly charged by primary charging unit C and exposed (or unexposed), after which surface potential is measured by potential sensor S in response to sampling pulses SD1 and SL1. The sampled surface potential is input to differential amplifiers 78 and 84 which apply feedback on high-voltage transformers HVTPR 79 and HVTG 85 so that the sampled surface potential matches the target values $V_{DM}$ and $V_{LM}$ which are input to D/A converters 77 and 83 via BUS 125 under control of a CPU (not shown) or the like. Buffers 82 and 87 hold drum surface potentials sensed by potential sensor S.

As described above, the surface potential control sequence is performed at each station for magenta, cyan, yellow, and black, operations of which are described below.

Figure 8:
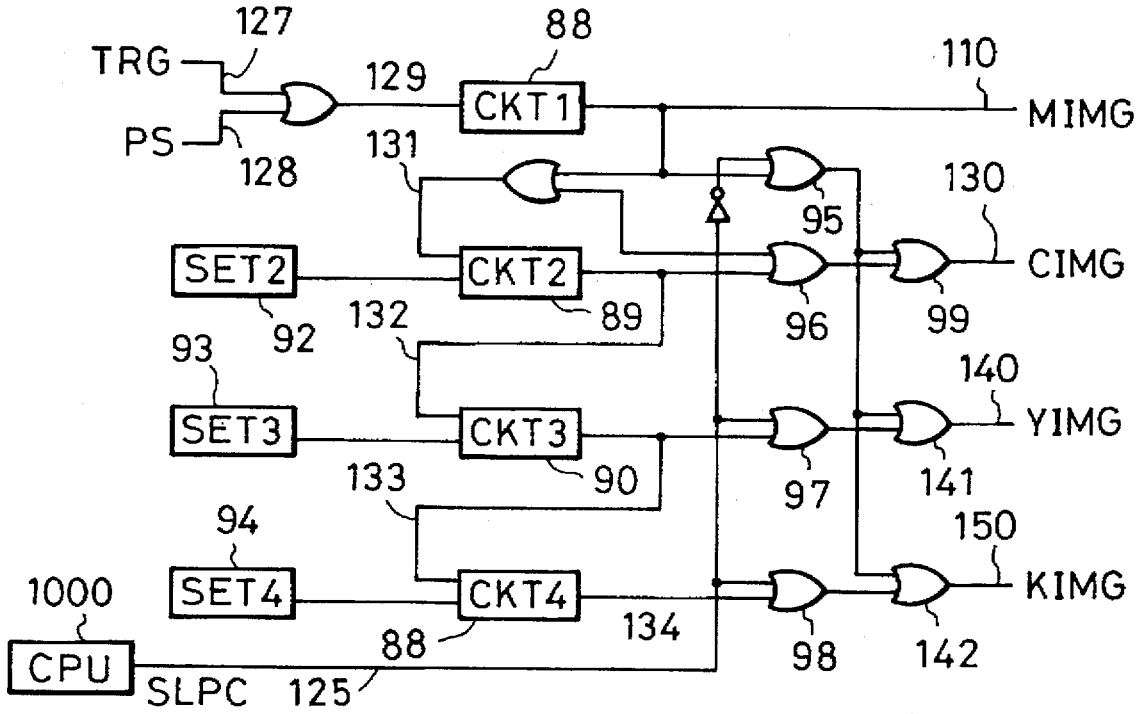
FIG. 8 shows an example of a timing signal generating circuit in the color image forming apparatus of the present invention.

FIG. 8 shows an example of a timing signal generating circuit in the color image forming apparatus of the present invention. This circuit corresponds to a circuit for generating timing signals MIMG 110, CIMG 130, YIMG 140, and KIMG 150 for starting respective surface potential control sequences for starting image formation sequences for magenta, cyan, yellow, and black.

Figure 9:
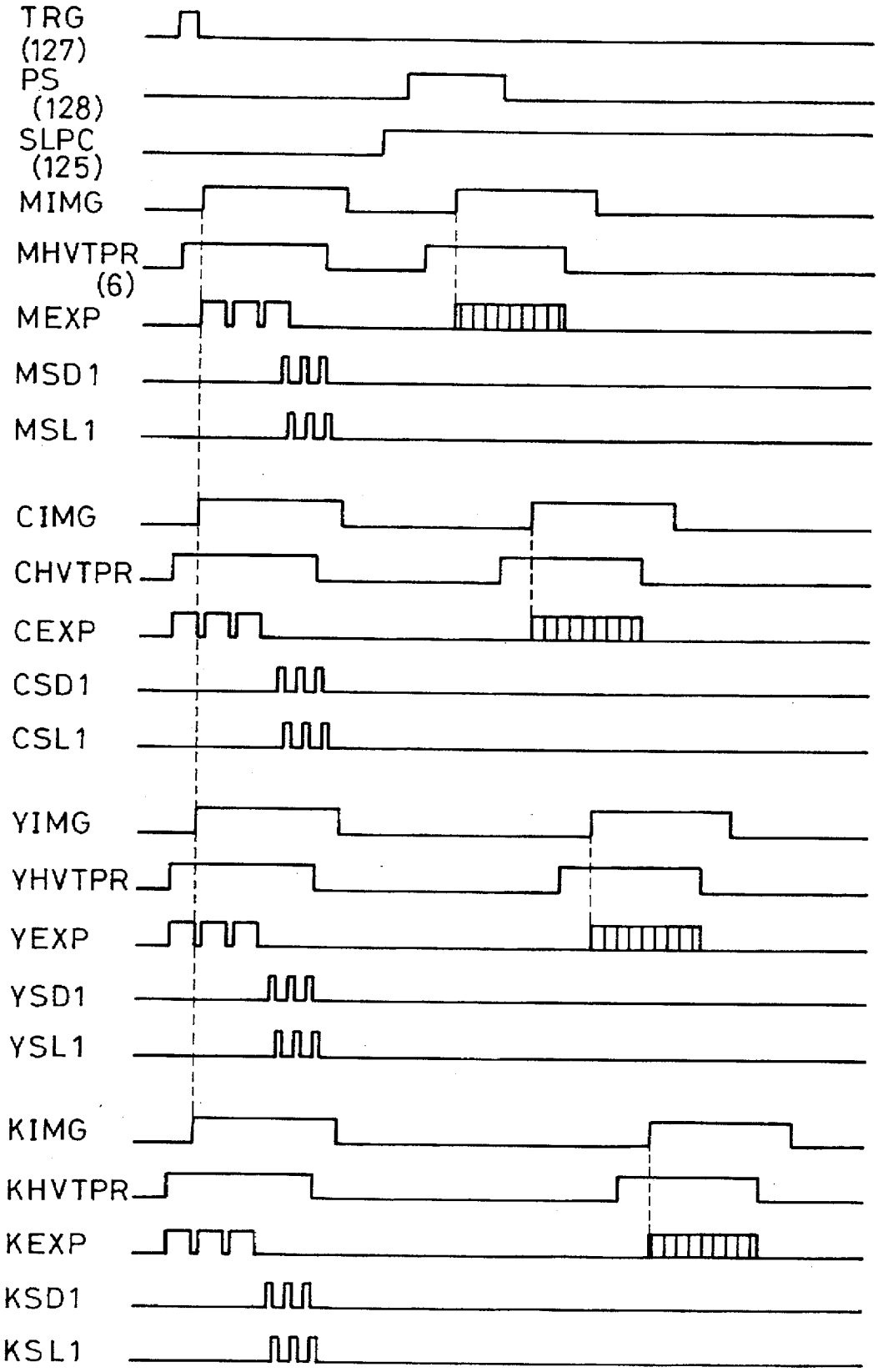
FIG. 9 shows a timing diagram illustrating an image forming sequence in the color image forming apparatus of the present invention.

FIG. 9 is a timing diagram illustrating the image forming sequence of the color image forming apparatus of the present invention.

When a copy button (not shown) is depressed, a load necessary for performing the sequence shown in FIG. 9 is driven. Prior to paper feed, to start the surface potential control sequence, CPU 1000 shifts signal SLPC 125 of an I/O port to a low level and generates trigger signal TRG 127. It is assumed that CPU 1000 is disposed within a controller of the image forming apparatus (not shown).

As a result, circuit CKT1 88, which generates a timing signal MIMG 110, generates MIMG 110, as well as CIMG 130, YIMG 140, and KIMG 150, which have a same timing as MIMG 110, via gates 95, 99, 141 and 142. Thus, as shown in FIG. 9, the surface potential control sequences are performed simultaneously at the stations for each color.

Upon the termination of this sequence, signal SLPC 125 is shifted to a high level, and the process proceeds to the ordinary image formation sequence.

Figure 19:
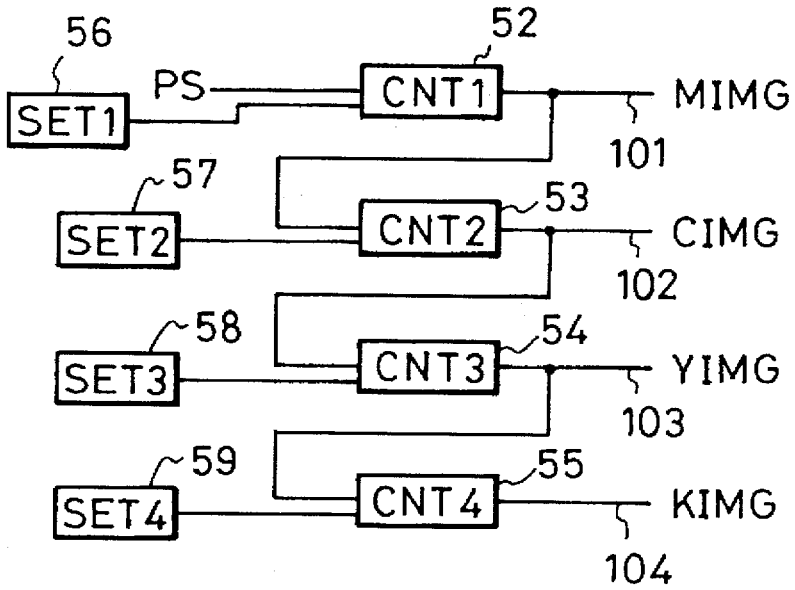
FIG. 19 shows an example of a circuit for generating the timing signals shown in FIG. 18.
Figure 20:
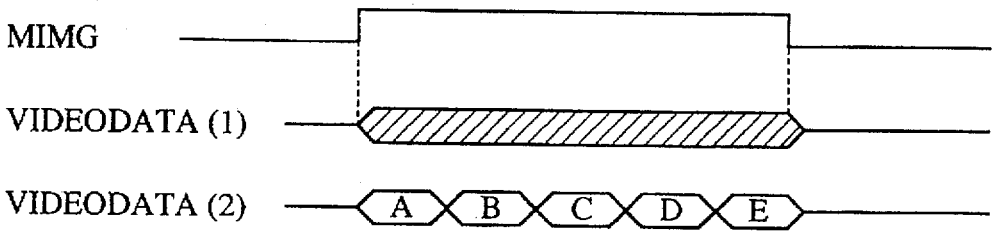
FIG. 20 is a timing diagram illustrating the operation of each of the sections of the timing signal generating circuit shown in FIG. 19.
Figure 21A:
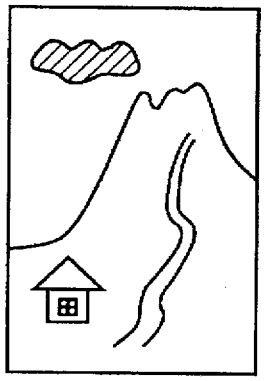
FIGS. 21(*a*) and 21(*b*) show an example of an image output from each image forming section in the color image forming apparatus shown in FIG. 17.
Figure 21B:
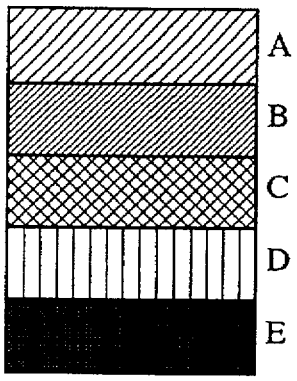
Figure 22:
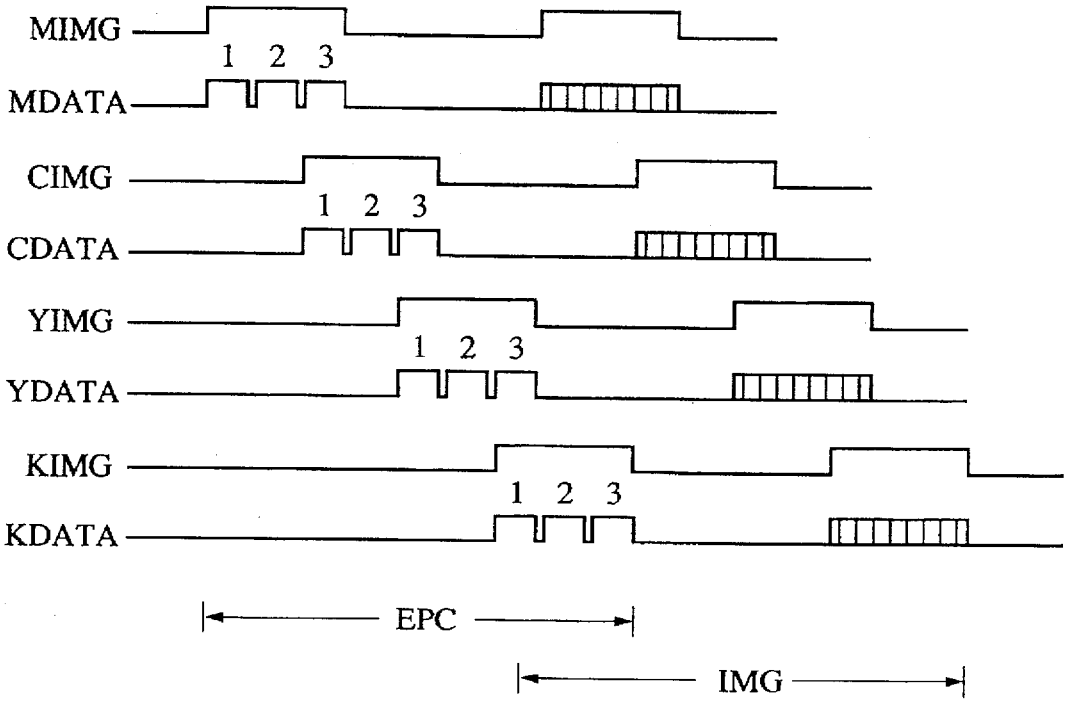
FIG. 22 is a timing diagram illustrating an image forming sequence of the four-drum color image forming apparatus shown in FIG. 17.

In this case, in the same way as in the operation explained with reference to FIG. 19, timing signals MIMG, CIMG, YIMG, and KIMG for forming the image are generated as a result of timing signal generating circuits (CKT2) 89, (CKT3) 90, and (CKT4) 91 being driven in sequence in response to signal PS 128 indicating that the position of the transfer paper has been detected, as shown in FIG. 9. As a result, toner images for each color are transferred sequentially onto transfer paper at each of the drum positions shown in FIG. 17.

[Second Embodiment]

Figure 10:
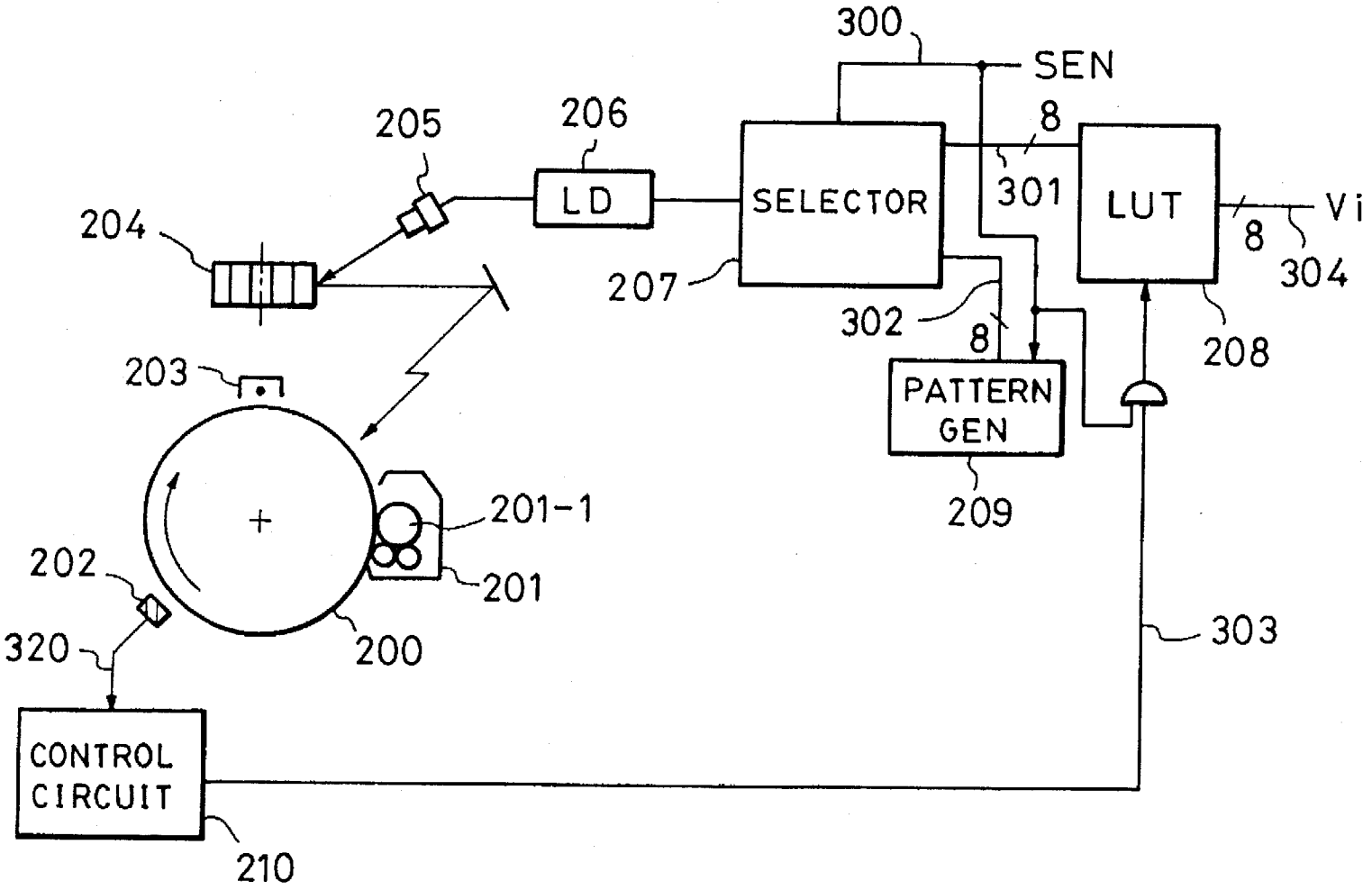
FIG. 10 shows a density stabilization control system according to a second embodiment of the color image forming apparatus of the present invention.

FIG. 10 shows an color image forming apparatus having a density stabilization control system according to a second embodiment of the present invention. More particularly, this embodiment is concerned with an image forming apparatus for performing density stabilization control of an image. According to this embodiment, light and dark patterns are formed on a photosensitive drum, an actual light and dark level on the drum is detected based on a light reflectance difference, and image formation is controlled based on a result of the detection so that an image having a stable density all the time is secured for the same image data.

In this embodiment, as shown in FIG. 10, signal SEN 300 is set so that output from pattern generator 209 is selected by selector 207. Data indicating that a predetermined density pattern is input to laser drive circuit 206 in order to drive laser 205 to form a grayscale pattern, an example of which is shown in FIG. 12 (described below).

Figure 11:
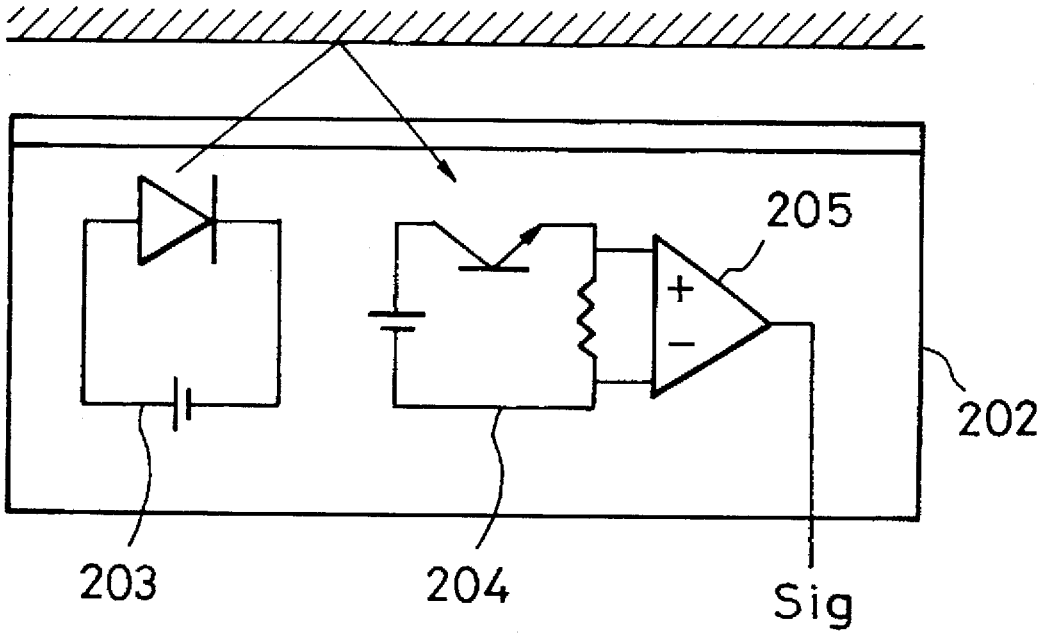
FIG. 11 shows the construction of a reflected light detecting apparatus disposed in the color image forming apparatus shown in FIG. 10.

The density of the image pattern is detected based on an amount of reflected light detected by a reflected light detecting apparatus shown in FIG. 11.

FIG. 11 shows a construction of the reflected light detecting apparatus disposed in the color image forming apparatus shown in FIG. 10. FIG. 12 shows the relationship between the grayscale pattern formed on the photosensitive drum 200 shown in FIG. 10 and input data.

Figure 12:
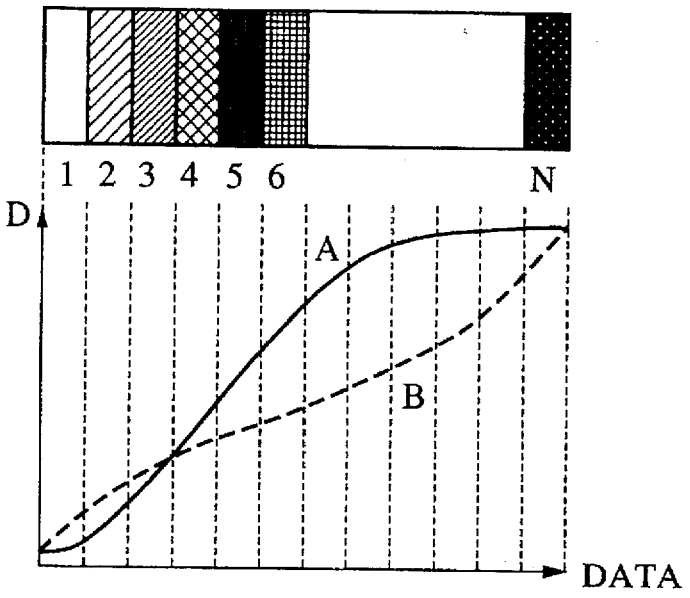
FIG. 12 shows the relationship between a grayscale pattern formed on the photosensitive drum shown in FIG. 10 and input data.

If, for example, the detected density having a characteristic indicated by solid line A in FIG. 12 is obtained for the indicating a predetermined density, and if gamma conversion, indicated by the dashed line in FIG. 12, is performed by referring to LUT (look-up table) 208 for image data (Vi) 304 of FIG. 10, the relationship between the density of image data 304 and the detected density becomes linear.

More specifically, control circuit 210 calculates the reverse characteristic (in this case, characteristic B) obtained from the detected pattern, and feedback is applied to LUT 208. As described above, density stabilization control is designed to ensure that images produced from the same input delay have a uniformly reflected density. In a color image forming apparatus having a plurality of drums located at a plurality of stations such as that shown in FIG. 17, it is possible to start this control sequence simultaneously for the plurality of stations (in the case of FIG. 17, four stations) in the same way as in the first embodiment.

Figure 13:
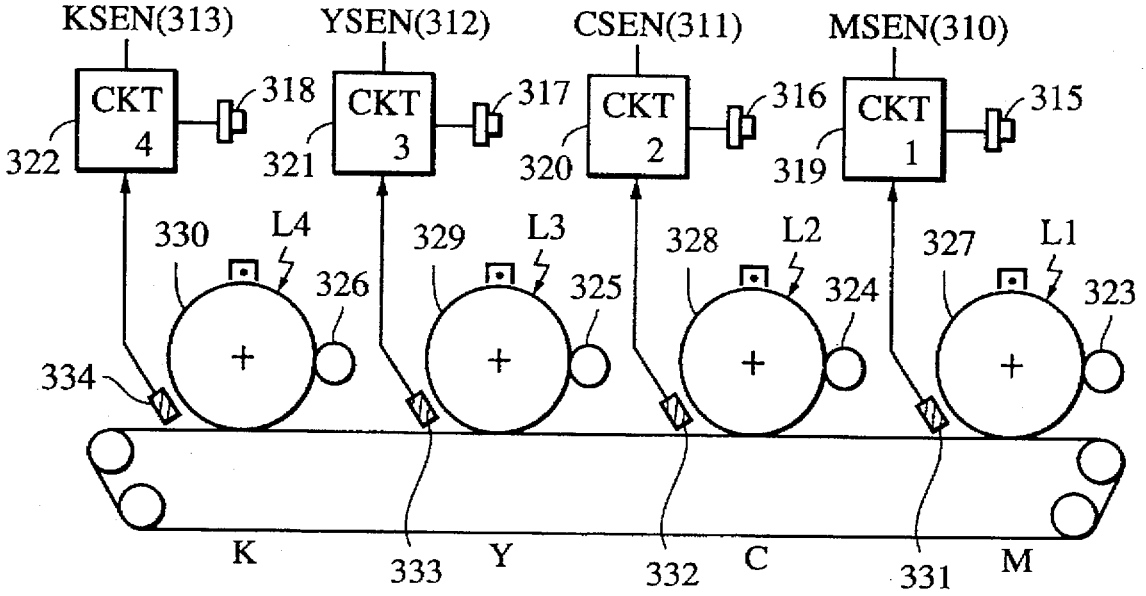
FIG. 13 shows the construction of the color image forming apparatus to which the density stabilization control shown in FIG. 10 is applied.

FIG. 13 shows the construction of a color image forming apparatus which implements the density stabilization control technique of FIG. 10.

As shown in FIG. 13, the four stations have, respectively, photosensitive drums 327 to 330, semiconductor lasers 315 to 318, development apparatuses 323 to 326, and density stabilization control units CKT1 to CKT4 which have the same function as the density stabilization control system shown in FIG. 10.

Since each station has the above density stabilization control mechanism, density stabilization control start signals MSEN 310, CSEN 311, YSEN 312, and KSEN 313 may be generated. The timings of these signals are shown in FIG. 14.

Figure 14:
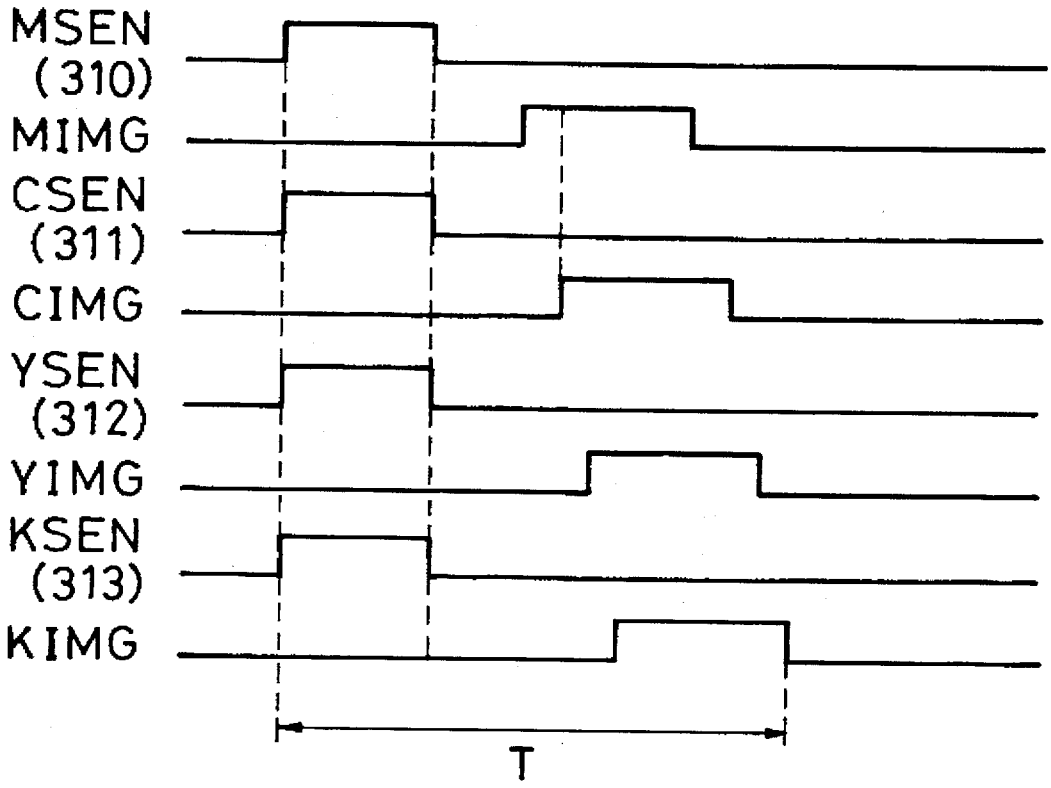
FIG. 14 is a timing diagram illustrating the timing at which the operation of the density stabilization control unit shown in FIG. 13 starts.
Figure 15:
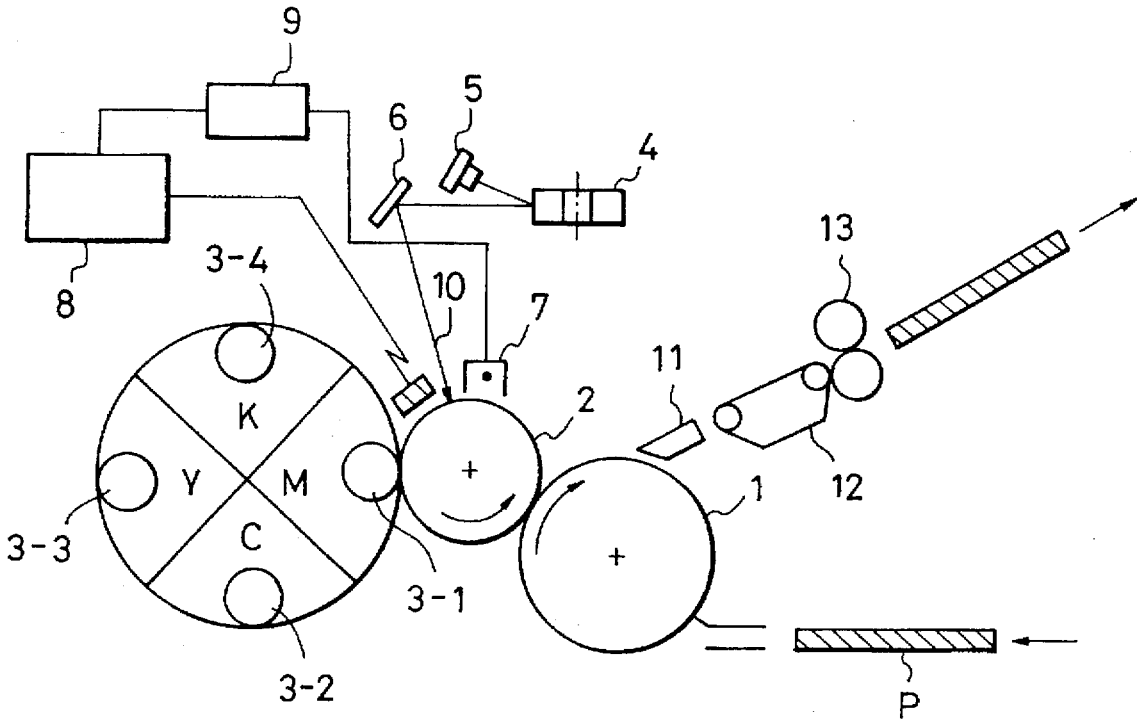
FIG. 15 shows the construction of the color image forming apparatus of the present invention.
Figure 16:
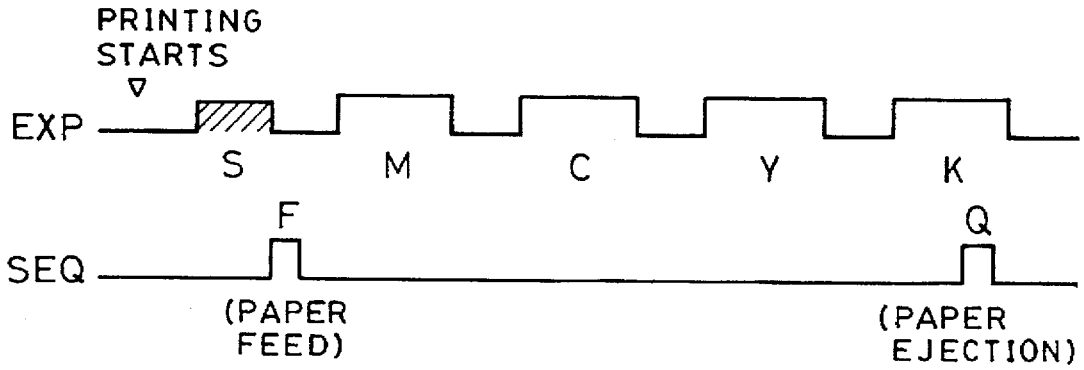
FIG. 16 is a timing diagram illustrating an example of an image forming sequence in the color image forming apparatus shown in FIG. 15.

FIG. 14 is a timing diagram illustrating timings at which operations of density stabilization control units CKT1 to CKT4 shown in FIG. 13 start.

In FIG. 14, MIMG, CIMG, YIMG, and KIMG are start signals in each station in the ordinary image formation sequence. These signals have the same function as in the first embodiment and are output at the same timing.

The above-described density stabilization control is performed by the four stations simultaneously in synchronization with a rise of a density stabilization control start signals MSEN 310 to KSEN 313, and then image formation is performed in sequence at each station in synchronization with a rise of each of start signals MIMG, CIMG, YIMG, and KIMG.

As a result, the time required for the copy operation, including image stabilization control operation, can be kept within a minimum time T.

According to this embodiment, as described above, the sequence for potential control is separated from the sequence for forming an image on transfer paper. A first mode in which image formation sections are driven in sequence in synchronization with the transport of the transfer paper and a second mode in which image formation sections are driven in parallel regardless of transport of the transfer paper, are provided. By performing the first mode after the second mode, it is possible to considerably decrease the conventional control time necessary for printing to start.

Many different embodiments of the present invention may be constructed without departing from the spirit and scope of the present invention. It should be understood that the present invention is not limited to the specific embodiments described in this specification. To the contrary, the present invention is intended to cover various modifications and equivalent arrangements included within the spirit and scope of the claims. The following claims are to be accorded the broadest interpretation, so as to encompass all such modifications, equivalent structures and functions.

What is claimed is:

1. An image forming apparatus, comprising:

transport means for transporting a transfer medium;

a plurality of image forming stations, each of which includes a recording medium onto which an image is formed, image forming means for forming the image on the recording medium, and transferring means for transferring the image formed on the recording medium onto the transfer medium transported by said transport means;

control means for controlling formation of a color image by starting operation of each of the plurality of image forming stations sequentially in a predetermined order so as to transfer an image of a different color formed by each of the plurality of image forming stations onto the identical transfer medium; and a plurality of measuring means, each for measuring a state of the image formed on a respective one of the plural recording media of the plurality of image forming stations, wherein said control means is operable also to start operation of the plurality of image forming stations substantially simultaneously in order to form on each recording medium an image for measurement, and to determine suitable operating conditions of each image forming means in the plurality of image forming stations for forming the color image based on the state of the image measured by each of the plurality of measuring means.

2. An image forming apparatus according to claim 1, wherein each image forming means in the plurality of image forming stations forms an image of a different color.

3. An image forming apparatus according to claim 1, wherein each of the plurality of measuring means measures an electrical potential of a latent image formed on a recording medium.

4. An image forming apparatus according to claim 1, wherein each of the plurality of measuring means measures a density of an image formed on a recording medium.

5. A controlling method in an image forming apparatus which comprises a plurality of image forming stations, each of which includes a photosensitive member, image forming means for forming a latent image on the photosensitive member, developing means for developing the latent image formed on the photosensitive member, and transfer means for transferring the image developed on the photosensitive member to a transfer medium, said image forming apparatus further including control means for controlling formation of a color image by starting operation of each of the plurality of image forming stations sequentially in a predetermined order so as to transfer an image of a different color formed in each of the plurality of image forming stations onto the identical transfer medium, and a plurality of measuring means, each for measuring an electrical potential of a surface of a respective one of the plural photosensitive members, said controlling method comprising the steps of:

starting substantially simultaneously the operation of the plurality of image forming stations in order to form on each photosensitive member a latent image for measurement;

measuring substantially simultaneously an electrical potential of a surface of the latent image to be measured formed on each photosensitive member by using each of the plurality of measuring means; and determining suitable operation conditions of each image forming means in the plurality of image forming stations for forming the color image based on the state of the latent image measured by each of the plurality of measuring means.

6. A controlling method in an image forming apparatus which comprises a plurality of image forming stations, each of which includes a photosensitive member, image forming means for forming an image on the photosensitive member, and transfer means for transferring the image formed on the photosensitive member to a transfer medium, said image forming apparatus further including control means for controlling formation of a color image by starting operation of each of the plurality of image forming stations sequentially in predetermined order so as to transfer an image of a different color formed in each of the plurality of image forming stations onto the identical transfer medium, and a plurality of measuring means, each for measuring a density of an image formed on a respective one of the plural photosensitive members, said controlling method comprising the steps of:

starting substantially simultaneously the operation of the plurality of image forming stations in order to form on each photosensitive member an image for measurement;

measuring substantially sequentially a density of the image to be measured formed on each photosensitive member by using each of the plurality of measuring means; and determining suitable operating conditions of each image forming means in the plurality of image forming stations for forming the color image based on the state of the image measured by each of the plurality of measuring means.

7. An image forming apparatus, comprising:

a plurality of image forming stations, each of which includes a recording medium, image forming means for forming an image on the recording medium, and transfer means for transferring the image formed on the recording medium to a transfer medium;

control means for controlling formation of a color image by starting operation of each of the plural image forming stations sequentially in predetermined order so as to transfer an image of a different color formed in each of the plurality of image forming stations onto the identical transfer medium; and a plurality of measuring means, each for measuring a state of the image formed on a respective one of the plural recording media in the plurality of image forming stations, wherein said control means determines suitable operating conditions of each image forming means in said plurality of image forming stations based on the state of the image measured by each of the plurality of measuring means, and further comprises generating means for generating a plurality of timing signals in order to start each operation of the plurality of image forming stations, said generating means generating each of the plurality of timing signals sequentially in a predetermined order in order to start operation of each of the plurality of image forming stations in the predetermined order when forming the color image, and generating each of the plurality of timing signals substantially simultaneously in order to start operation of each of the plurality of image forming stations substantially simultaneously when determining the suitable operating conditions of each image forming means in the plurality of image forming stations.

8. An image forming apparatus according to claim 7, wherein each of the plurality of measuring means measures an electrical potential of a latent image formed on a recording medium.

9. An image forming apparatus according to claim 7, wherein each of the plurality of measuring means measures a density of an image formed on a recording medium.

* * * * *